US005121726A

United States Patent [19]

Di Nunzio et al.

[11] Patent Number: 5,121,726

[45] Date of Patent: Jun. 16, 1992

[54] METHOD AND EQUIPMENT FOR CONTROLLING THE IDLING SPEED OF AN INTERNAL COMBUSTION ENGINE

[75] Inventors: Vittorio Di Nunzio, Turin; Maurizio Abate, Orbassano; Carlo Canta; Norberto Dosio, both of Turin, all of Italy

[73] Assignee: Fiat Auto SpA, Turin, Italy

[21] Appl. No.: 696,797

[22] Filed: May 7, 1991

[30] Foreign Application Priority Data

May 7, 1990 [IT] Italy ..... 67333 A/90

[51] Int. Cl.[5] ..... F02D 41/16; F02P 5/15

[52] U.S. Cl. ..... 123/339; 123/418

[58] Field of Search ..... 123/339, 418

[56] References Cited

U.S. PATENT DOCUMENTS 4,492,195 1/1985 Takahashi et al. ..... 123/339

4,638,778 1/1987 Kamei et al. ..... 123/339

4,653,449 3/1987 Kamei et al. ..... 123/339 X 4,785,780 11/1988 Kawai ..... 123/339

*Primary Examiner*—Tony M. Argenbright

*Attorney, Agent, or Firm*—Sughrue, Mion, Zinn Macpeak & Seas

[57] ABSTRACT

The idling speed of an internal combustion engine is regulated with the use of an electronic control unit arranged to generate a signal for correcting the ignition advance and a signal for varying the piloting of a solenoid valve provided in a duct which by-passes a throttle valve which controls the air supply to the engine. For this purpose, the electronic unit acquires the instantaneous speed of the engine and the air pressure in the inlet manifold by means of sensors. The electronic unit implements an LQI (linear-quadratic-integral) type of control based on a linear mathematical model of the engine.

6 Claims, 4 Drawing Sheets

METHOD AND EQUIPMENT FOR CONTROLLING THE IDLING SPEED OF AN INTERNAL COMBUSTION ENGINE

BACKGROUND OF THE INVENTION

The present invention relates to a method and equipment for the feedback control of the idling speed of an internal combustion engine to which air is supplied in operation through a duct with a throttle valve.

Various systems have been proposed for controlling the idling speed of an internal combustion engine, their purpose being to reduce, as far as possible, the fluctuations in the engine speed, which may be caused, for the most part, by:

the application of resisting torques which cause the rate of revolution of the engine to fall, for example due to the operation of air-conditioning systems for the passenger compartment or servo-steering devices;

oscillations in the speed of the engine on open circuit under minimum load conditions, which are related to the structure and operation of the engine itself; and the fact that, at the idling speed., the internal combustion engine is operating in an area of its speed-torque diagram (the area of slowest speed and minimum torque) for which its design is not normally optimised: this means that, at the idling speed, the engine operates with poor efficiency and with irregular combustion which results in fluctuations in the torque generated of the same order of magnitude as the average torque delivered, and this causes variations in the engine speed.

Various systems based on conventional control techniques, for example so-called PID (proportional-integral-derivative) systems, have been proposed and produced for controlling and regulating the idling speed of internal combustion engines. The precision of regulation achieved by these conventional control systems is limited and, moreover, they lack robustness and adaptability.

Recently, designers active in the field of engine control have started to produce regulatory devices based on more modern control techniques, such as the so-called "Robust Controllers".

SUMMARY OF THE INVENTION

The object of the present invention is to provide an improved method and equipment for the feedback control of the idling speed of an internal combustion engine which are, at the same time, both efficient and "robust", that is, which are not critically sensitive to calibration carried out on a particular engine but are adapted to achieve satisfactory operation even with variations in the parameters of the engine characteristics, for example, variations due to ageing or to tolerances intrinsic in the manufacturing processes.

These and other objects of the invention are achieved by means of a control method characterised in that it comprises the following steps:

a) detecting the speed of the engine and the air pressure in the inlet manifold of the engine;

b) calculating the difference or error between the engine speed detected and a predetermined "target" speed and the difference or error between the air pressure detected in the inlet manifold and a predetermined reference pressure;

c) calculating the integral of the engine speed error;

d) selecting from a pre-calculated matrix of gain coefficients, the values of the coefficients which correspond to the instantaneous values assumed by four predetermined variables relating to the state of the engine; the matrix correlating the variations in the quantity of air to be supplied to the engine and the variations in the ignition advance with the instantaneous values assumed by the speed error, by the integral of the speed error, by the air-pressure error and by a further state variable relating to the internal state of a differential operator which acts on the value of the advance variation; the values of the coefficients of the gain matrix being calculated beforehand on the basis of a linear system of fourth-order equations which in accordance with the characteristics of a predetermined linear mathematical model of the engine, functionally correlate the aforesaid state variables with the quantity of air supplied to the engine and with the ignition advance, and on the basis of the calculation of a performance index predefined as a function of the state variables, of the quantity of air supplied to the engine, and of the ignition advance;

e) differentiating, by means of the said differential operator, the advance-variation value which corresponds to the values of the gain coefficients selected from the matrix; and f) determining the quantity of air to be supplied to the engine and the ignition advance to be applied to the engine in dependence on the value supplied by the differential operator and on the coefficients selected from the gain matrix.

The invention also relates to equipment for the feedback control of the idling speed of an internal combustion engine which implements the method defined above.

DETAILED DESCRIPTION OF THE INVENTION

Further characteristics and advantages of the invention will become clear from the detailed description which follows, with reference to the appended drawings, provided purely by way of non-limiting example, in which.

Figure 1:
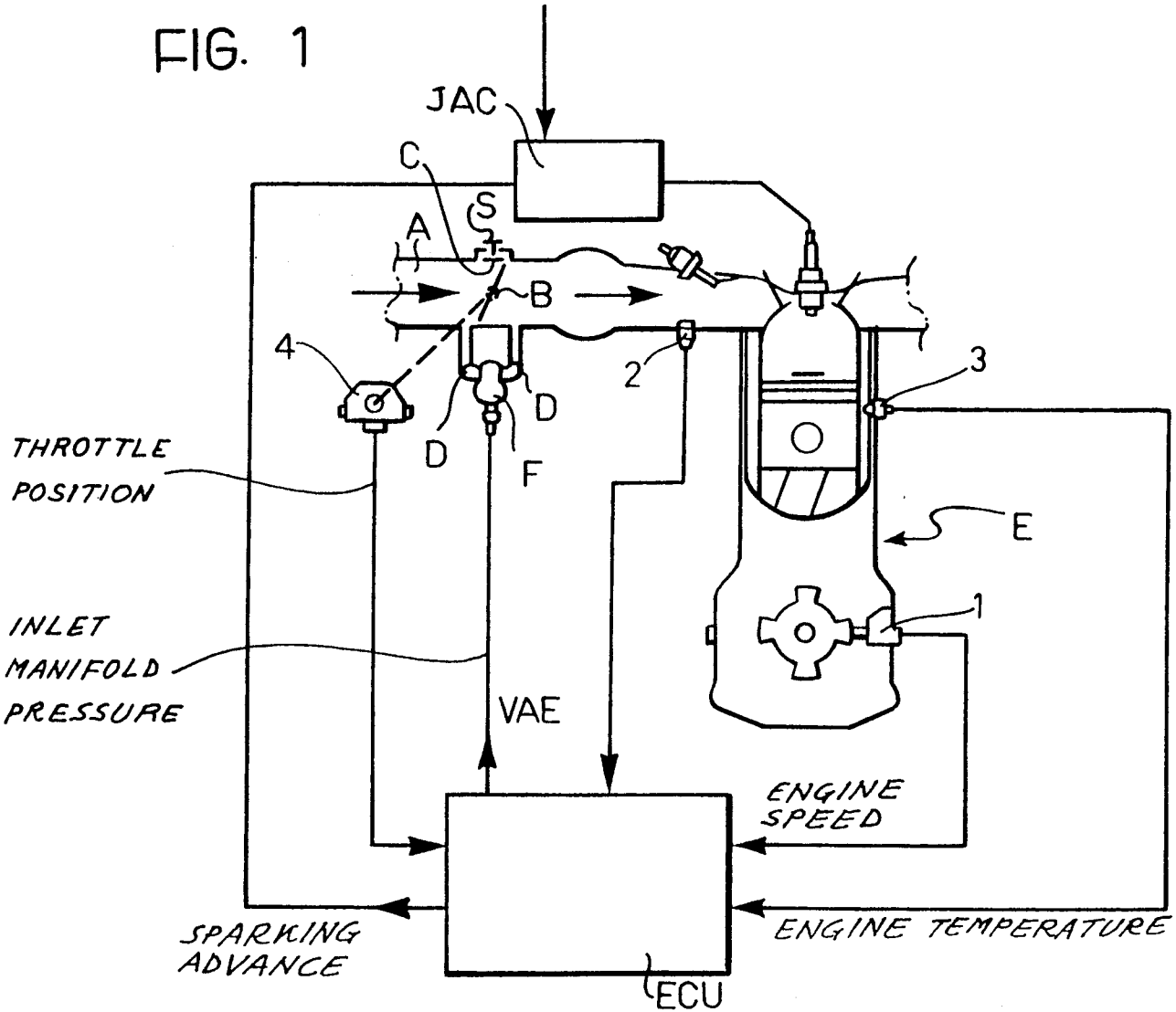
FIG. 1 is a diagram of a control system according to the invention.

With reference to FIG. 1, an air inlet duct of an internal combustion engine E with spark ignition is indicated A. Air coming from a filter (not shown) passes through this duct to the engine E, in the direction of the arrows shown.

The duct A includes a throttle valve indicated B.

Two by-pass ducts indicated C and D extend between the regions upstream and downstream of the throttle valve B. A regulating screw S is provided, in known manner, in the bypass duct C.

The rate of flow of the air through the by-pass duct D is controlled by a solenoid valve F.

An engine speed sensor, for example of the phonic wheel type, is indicated 1.

A sensor, indicated 2, for sensing the air pressure in the duct A is provided downstream of the by-pass duct D.

An electrical sensor for sensing the temperature of the engine E and a sensor for sensing the position of the throttle valve B are indicated 3 and 4. The latter may, for example, be of the potentiometric type.

The sensors 1 to 4 are connected to corresponding inputs of an electronic control unit generally indicated ECU in FIG. 1. This unit has a first output which controls the solenoid valve F and a second output which is connected to the input of an ignition-advance control device, indicated IAC.

As will be explained more fully below, the unit ECU regulates the idling speed of the engine E by modifying the duty-cycle of the control signal PWM for the solenoid valve F and by supplying the control device IAC with a signal for correcting the advance.

The solenoid valve F is able to exert a sensible effect on the quantity of air supplied to the engine E within quite a wide range of engine speeds, for example, within a band of approximately 2,500 revolutions per minute. A variation in the duty-cycle of the control signal for the solenoid valve cannot however, produce immediate results because of intrinsic delays due, for example, to the volumetric capacity of the inlet manifold and because of delays introduced by the intake and compression phases.

The problem connected with these delays is resolved, to advantage, by action not only on the rate of flow of the air supplied to the engine but also on the ignition advance. In fact, a variation in the ignition advance (which can itself modify the engine speed within a rather narrow dynamic range, for example, of about 100 revolutions per minute about the operating speed) has an almost immediate effect on the mixture compressed in the combustion chamber.

The two main quantities which are measured in the engine E for the purposes of closing the control loop are the instantaneous speed of the engine and the absolute pressure in the inlet manifold.

In addition to the signals mentioned above, the unit ECU also acts on the basis of auxiliary signals supplied thereto by the temperature sensor 3 and by the position sensor 4 associated with the throttle valve B.

More particularly, the temperature sensor 3 serves the unit ECU for the selection from its memory of the correct reference values for the engine speed, the inlet manifold pressure and the reference values for the duty-cycle of the solenoid valve F and the ignition advance.

The information provided by the position sensor 4, however, indicates whether the engine is idling and thus serves, in the final analysis, to cause the intervention or the de-activation of the idling-speed control.

The control system according to the invention is based on a mathematical model of the engine which will now be described with reference to FIG. 2.

In general, in order to describe the dynamic behaviour of an internal combustion engine which is to be controlled, it is necessary to define a mathematical model thereof which takes account of certain predetermined objectives to be achieved and, in particular, the frequency band in which the model should be valid.

In defining the structure of the mathematical model to be adopted, a first, fundamental decision which must be made is whether to use a "black-box" type model or a model based on physical operating principles of the engine.

In a "black-box" type model, the parameters which define the model have no immediate physical significance and do not, therefore, permit of qualitative comparisons between engines of different types or between different examples of the same type of engine. Since, in such a case, the state variables have no direct physical significance, they cannot be measurable directly. A model of the "black-box" type thus necessitates the use of a so-called "state observer" with a consequent increase in the work-load on the processing unit.

A mathematical model based on the physical operating principles of the engine, on the other hand, permits the use of state variables which have immediate physical significance. It is thus possible to refine the model while it is being established and, if necessary, to correct it progressively so as to take account more and more thoroughly of aspects of the engine's operation.

As regards the mathematical model to be adopted, a further decision to be taken concerns the order of the model. A high-order model would enable simulations to be made with quite a high degree of realism but would again involve considerable overload of activity for the processing unit. For this reason, the mathematical model adopted in the system according to the invention is a second-order model.

The band width of the model adopted is approximately 1 Hz. This means that the impulsive components of the engine speed and of the absolute pressure in the inlet manifold are not detected and the division of the combustion cycle into the intake, compression, expansion and exhaust stages does not therefore appear in the model, nor is the fact that the engine is a multi-cylinder system taken into consideration. It is therefore assumed that the system has a continuous mode of operation.

The range of variation of the idling speed of the engine is quite limited compared with the overall range of variability of the engine speed. In fact, whilst during idling the speed may vary between, for example, 700 and 1,100 revolutions per minute, the absolute range of variation of the speed may, for example, be between 700 and 7,000 revolutions per minute.

It is thus possible to adopt a simplified model and, in particular, a linear model with a validity range of about $\pm 200$ revolutions per minute about the nominal speed (900 revolutions per minute) so that linearisation is achieved.

The model adopted is expressed in terms of incremental variables. In other words, the values of the quantities expressed in the model do not represent the total, absolute values of the variables, but the variations in those variables relative to respective reference values.

Figure 2:
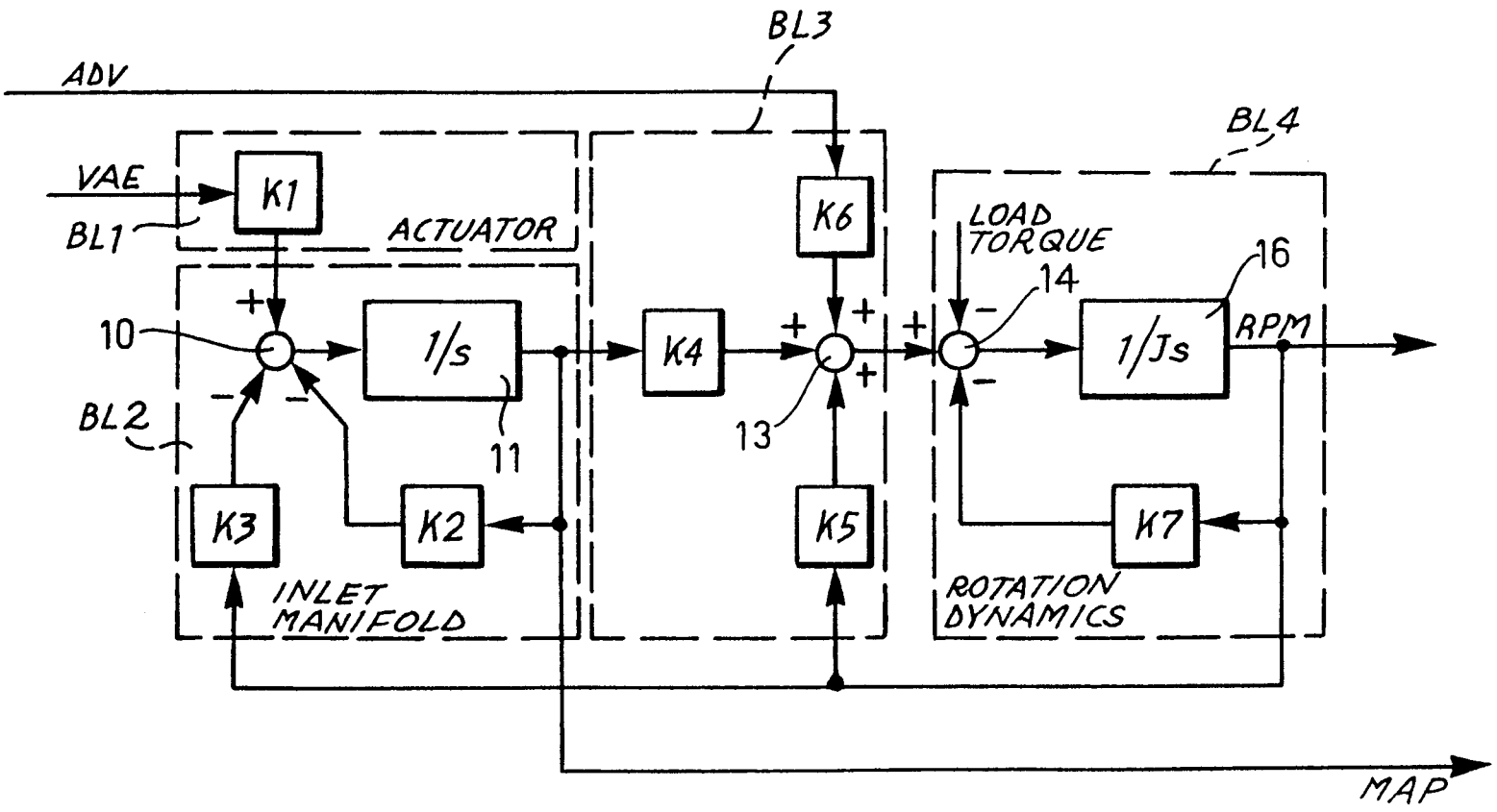
FIG. 2 is a block diagram showing a mathematical model of the engine.

With reference to FIG. 2, in the mathematical model adopted in the system according to the invention, the engine is shown schematically while idling in four functional blocks indicated BL1, BL2, BL3 and BL4.

The block BL1 represents the electromagnetic actuator piloted by the control unit ECU, that is, the solenoid valve F of FIG. 1.

The block BL2 represents the inlet manifold A of the engine.

The block BL3 takes account of phenomena connected with the combustion chamber.

The block BL4 takes account of the moving mechanical parts of the engine.

The block BL1 in fact comprises a gain block K1 which receives a variable duty-cycle (PWM) signal indicated VAE at its input.

The output of the block K1 represents the air flow admitted to the inlet manifold. The gain K1 is thus the relationship between the air flow and the duty-cycle of the solenoid valve F.

The block BL2 includes an adder 10 which receives the output of the block K1 and the output of a gain block K3 with positive and negative signs respectively. This latter block takes account of the pumping action of the pistons in the cylinders and receives at its input the rate of revolution (RPM) of the engine from the block BL4. The output of the adder 10 is fed to an integrator 11. The quantity, indicated MAP, output by the integrator is the absolute pressure in the inlet manifold of the engine.

A block K2 is interposed between the output of the integrator 11 and an input of the adder 10 which has a negative sign and takes account of the delay introduced by the filling of the capacity of the system. The gain K2 is inversely proportional to the volume of the inlet manifold.

The block BL3 includes a gain block K4 whose input is connected to the output of BL2. The block K4 takes account of the relationship between the pressure MAP in the manifold A and the torque produced.

The block BL3 includes an adder 13 to which are fed the ignition advance signal ADV, through a gain block K6, and the output of a gain block K5, whose input is supplied with the engine speed signal (RPM). This latter block takes account of the variations in the volumetric efficiency of the engine with variations in its speed.

Dimensionally, the quantity output by the block BL3 is a torque and this is fed, with a positive sign, to the input of an adder 14 in the block BL4 which receives, with negative signs, a signal indicative of the load torque and the output of a gain block K7, which represents the coefficient of viscous friction.

The output of the adder 14 is fed to the input of an integrator 16 with a transfer characteristic of 1/Js, where J represents the moment of inertia of the engine and s represents the Lapeace variable.

The values of the parameters of the mathematical model of the engine, according to FIG. 2, can be determined, for a particular internal combustion engine, by means of a certain number of experimental adjustments.

As will become clearer from the following, the mathematical model of FIG. 2 enables the determination of the characteristics of the LQI controller adopted in the system according to the invention, whose layout will now be described with reference to FIG. 3. The functions and operations of the LQI controller are actually carried out in the electronic control unit ECU of the system.

Figure 3:
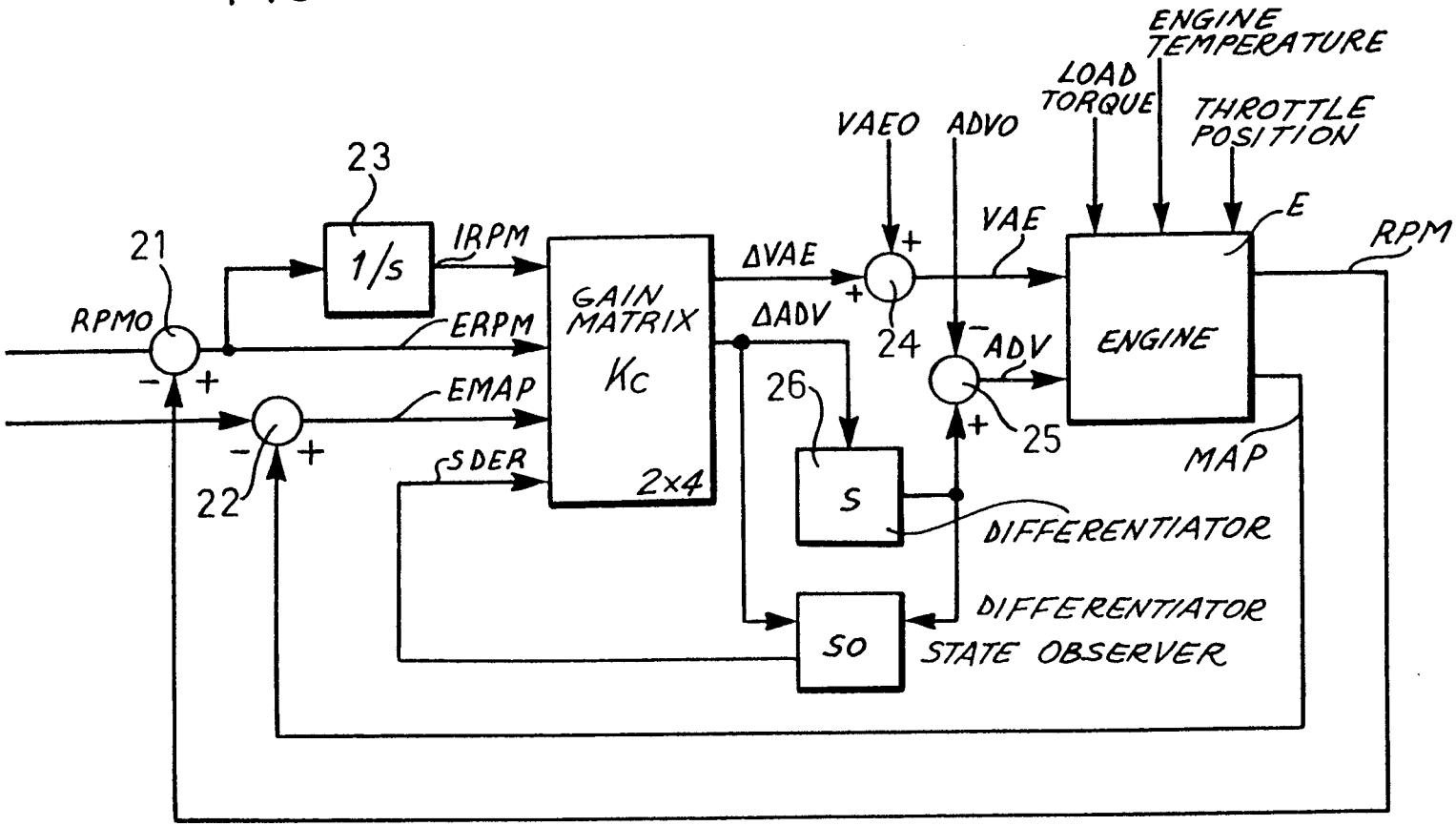
FIG. 3 is a functional block diagram of an LQI control system according to the invention.

In the controller of FIG. 3, respective predefined reference values RPM0 and MAP0 are subtracted at 21 amd 22 from the current speed RPM and absolute pressure MAP in the inlet manifold. The difference or error values ERPM and EMAP speed and pressure are thus available at the outputs of the blocks 21 and 22.

Still in FIG. 3, the integral of the speed error ERPM is indicated IRPM and is available at the output of an integration operator 23 whose input is connected to the output of the adder 21.

The integrator 23 compensates for the static variations in the engine speed caused by loads which exert a continuous braking action such as, for example, an electric fan.

On the basis of the variables IRPM, ERPM and EMAP, and of a further state variable SDER, which will be defined more fully below, a gain matrix Kc is produced and, in the embodiment shown, has dimensions of 2×4. The matrix contains the values of gain coefficients, which are calculated beforehand in the manner which will be described below, and correlates the variations in the quantity of air to be supplied to the engine and the variations in the advance with the instantaneous values assumed by the state variables IRPM, ERPM, EMAP and SDER.

On the basis of the values of the state variables, corresponding incremental values ΔVAE and ΔADV of the duty-cycle for the signal for piloting the solenoid valve F and of the ignition advance, respectively, are obtained from the matrix Kc. At 24, a reference value VAEO is added to ΔVAE whilst, at 25, an ignition advance reference value ADV0 is added to the incremental value ΔADV (after differentiation in a differential operator 26). The complete signals VAE and ADV output by the adder blocks 24 and 25 are applied to the engine E.

The reference values VAEO, ADVO, RPMO and MAPO conveniently are tabulated in memory devices of the unit ECU as functions of the engine temperature detected by the sensor 3 of FIG. 1.

With reference again to FIG. 3, the output of the differential operator 26 and the output ΔADV of the matrix Kc are connected to the input of a state observer SO. The state variable SDER output by the state observer SO thus represents the internal state of the differentiator 26.

The presence of the differentiator 26, which brings the incremental correction of the ignition advance to zero when the latter is constant, eliminates the permanent drift of the advance from its set value. This does not involve any limitation as regards this input since the correction of the ignition advance takes effect mainly in the initial part of a transient, after a disturbance has arisen, when a rapid dynamic correction is necessary and the rapid correction is not disturbed by the action of the differentiator.

If the equations represented by the integrator 23 and the differentiator 26 are incorporated in the mathematical model of FIG. 2, a fourth-order model of the system can be obtained, in known manner, in the following canonical form $$x(K+1)=A\times(k)+B\,u(k) \quad (1)$$

$$y(k)=C\times(k) \quad (2)$$

where $u=[VAE, ADV]^T$ is the vector of the inputs, $x=[IRPM, EMAP, ERPM, SDER]^T$ is the vector of the states, $y=[ERPM, EMAP]$ is the output, A, B and C are matrices of coefficients which depend on the model (FIG. 2) of the engine, and k represents a current value and K+1 represents the subsequent value.

From the above equations, the following is derived for the closure of the control loop:

$$u=K_c{}^*x$$

In order to calculate the coefficients Kc, a performance index is used, which is defined as follows:

$$I = \sum_{k=0}^{\infty} [x^T(k)\, Q \times (k) + u^T(k)\, R\, u(k)] \quad (3)$$

I represents a quadratic cost index constituted by the integral with time of the square of the deviations of the states and of the input quantities from their nominal values, which are zero since, in the case of the present model, incremental variables are adopted. This index is therefore a positive quantity which must be minimised.

In the equation for I given above, Q and R represent positive diagonal matrices which determine the weights of the individual components of x and u in the formation of the index I.

The solution of the problem as a whole is given by the following equation:

$$K^c = -(R + B^T PB)^{-1} B^T PA \quad (4)$$

in which the matrix P is the solution of the Riccati equation:

$$P = Q + A^T PA - A^T PB(R + B^T PB)^{-1} B^T PA \quad (5)$$

From equations (4) and (5) given above, it can be seen that the matrix Kc depends on the model adopted for the engine (by means of the matrices A and B) and also depends on the weights assigned to x and u (by means of the matrices Q and R). In other words, the matrix Kc takes account of the dynamic behaviour of the engine and of the control objectives fixed by the designer.

In the present case, the diagonal matrices Q and R have dimensions of $4 \times 4$ and $2 \times 2$ respectively. In order to calculate Kc, it is therefore necessary to assign six weight coefficients.

It can be seen from equation (3) that the standardisation of Q and R with respect to one of the six elements of their diagonals is equivalent to multiplying I by a constant, and this therefore leaves the value of Kc unchanged, which minimises I. This enables the number of weights to be assigned to be reduced to five.

Figure 4:
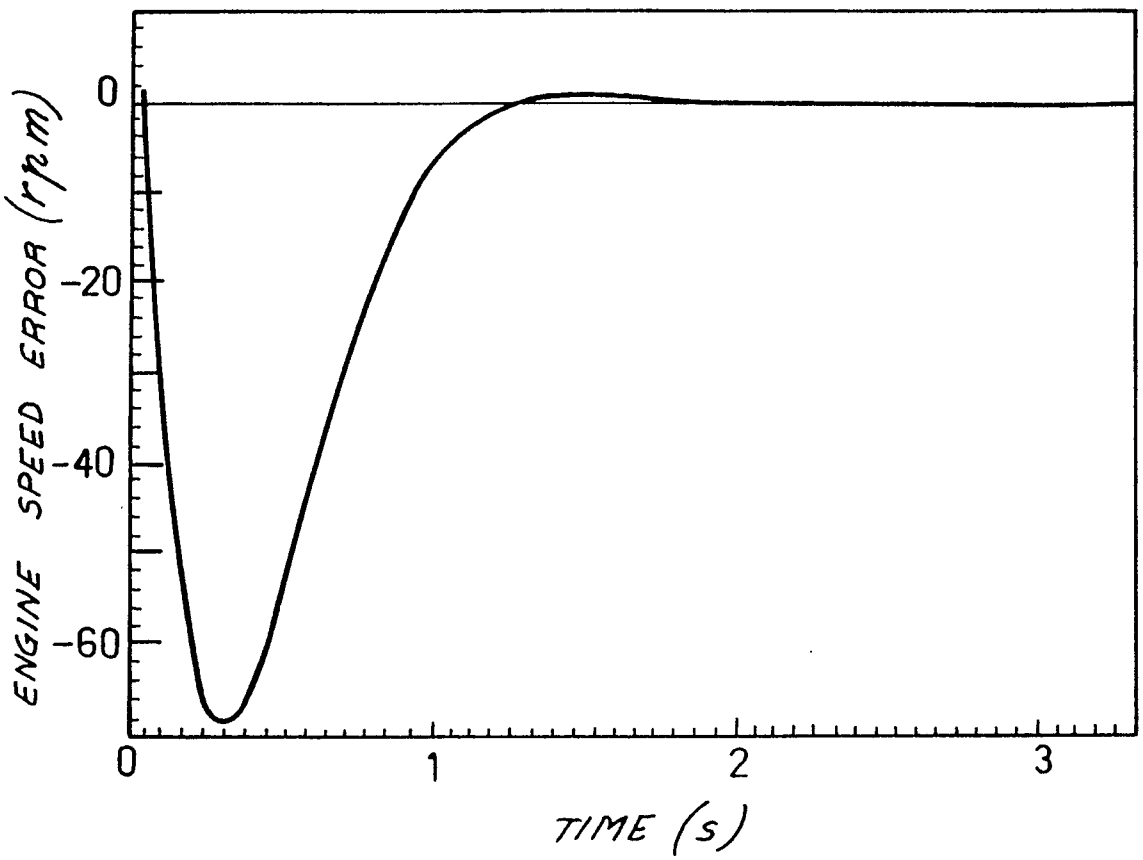
FIG. 4 is a graph showing an engine speed error, which simulates the operation of the servo-steering, as a function of time shown on the abscissa.

The weights which give the most satisfactory response were found by the inventors by the simulation, on a processor, of the closed-loop control system with different weight values, the internal combustion engine being subjected to the action of a braking torque disturbance equivalent to the operation of the servo-steering. The simulated closed-loop response for the gain matrix Kc*, calculated by means of equations (4) and (5) with the use of the selected matrices Q* and R*, is given in FIG. 4.

This figure shows the changes in the engine speed error as a function of time expressed in seconds on the abscissa.

The control algorithm described above was implemented with an electronic control unit formed with a 16-bit microprocessor.

Experimental tests carried out under various load conditions have shown that the control system according to the invention provides considerably better results than conventional PID control systems, both in terms of static and dynamic compensation and also as regards cold operation.

Naturally, the principle of the invention remaining the same, the forms of embodiment and details of construction may be varied widely with respect to those described and illustrated purely by way of non-limiting example, without thereby departing from the scope of the present invention.

What is claimed is:

1. A method for the feedback control of the idling speed of an internal combustion engine which is supplied, in operation, with air through a duct including a throttle valve; the method comprising the following steps:

a) detecting the speed of the engine and the air pressure in the duct of the engine;

b) calculating the difference or error between the engine speed detected and a predetermined target speed and the difference or error between the air pressure detected and a predetermined reference pressure;

c) calculating the integral of the engine speed error;

d) selecting from a pre-calculated matrix of gain coefficients, the values of the coefficients which correspond to the instantaneous values assumed by four predetermined variables relating to the state of the engine:

the matrix correlating the variations in the quantity of air to be supplied to the engine and the variations in the ignition advance with the instantaneous values assumed by the speed error, by the integral of that error, by the pressure error and by a further state variable relating to the internal state of a differential operator which acts on the value of the advance variation;

the values of the coefficients of the gain matrix being calculated beforehand on the basis of a linear system of fourth-order equations which, in accordance with the characteristics of a predetermined linear mathematical model of the engine, functionally correlate the aforesaid state variables with the quantity of air supplied to the engine and with the ignition advance and on the basis of the calculation of a performance index predefined as a function of the state variables, of the quantity of air supplied to the engine, and of the ignition advance;

e) differentiating, by means of the differential operator, the advance variation value corresponding to the values of the gain coefficients selected from the matrix; and f) determining the quantity of air to be supplied to the engine and the ignition advance to be applied to the engine in dependence on the value supplied by the differential operator and on the coefficients selected from the gain matrix.

2. A method according to claim 1, wherein the predetermined values of the speed and of the air pressure in the duct are variable according to predefined functions of the temperature of the engine.

3. A method according to claim 1, wherein the quantity of air to be supplied to the engine and the ignition advance to be applied tot he engine are determined as incremental values relative to predefined reference values, which are variable according to pre-established functions of the temperature of the engine.

4. A system for the feedback control of the idling speed of an internal combustion engine which is supplied in operation with air through a duct including a throttle valve; the system comprising in combination an electrically-controlled actuator device provided in a duct which by-passes the throttle valve for regulating the quantity of air supplied to the engine;

sensor means for providing electrical signals indicative of the speed of the engine and the air pressure in the inlet duct of the engine, and an electronic control unit connected to the actuator, to the sensor means and to means for controlling the ignition advance of the engine; the unit being arranged:

a) to detect the speed of the engine and the air pressure in the duct of the engine;

b) to calculate the difference or error between the engine speed detected and a predetermined target speed and the difference or error between the air pressure detected and a predetermined reference pressure;

c) to calculate the integral of the engine speed error;

d) to select from a pre-calculated matrix of gain coefficients, the values of the coefficients which correspond to the instantaneous values assumed by four predefined variables relating to the state of the engine;

the matrix correlating the variations in the quantity of air to be supplied to the engine and the variations in the ignition advance with the instantaneous values assumed by the speed error, by the integral of that error, by the air-pressure error and by a further state variable relating to the internal state of a differential operator which acts on the value of the advance variation;

the values of the coefficients of the gain matrix being calculated beforehand on the basis of a linear system of fourth-order equations which, in accordance with the characteristics of a predefined linear mathematical model of the engine, functionally correlate the aforesaid state variables with the quantity of air supplied to the engine and with the ignition advance and on the basis of the calculation of a performance index predefined as a function of the state variables; of the quantity of air supplied to the engine, and of the ignition advance;

e) to differentiate, by means of the differential operator, the advance variation value corresponding to the values of the gain coefficients selected from the matrix; and f) to pilot the electrically-controlled actuator and the means for controlling the ignition advance in dependence on the value supplied by the differential operator and the coefficients selected from the gain matrix.

5. A system according to claim 4, wherein the predetermined values of the speed and the air pressure in the duct are variable according to predefined functions of the temperature of the engine.

6. A system according to claim 4, wherein the quantity of air to be supplied to the engine and the ignition advance to be applied to the engine are determined as incremental values relative to predefined reference values, which are variable according to pre-established functions of the temperature of the engine.

* * * * *